US009566626B2

(12) United States Patent
Fest et al.

(10) Patent No.: US 9,566,626 B2
(45) Date of Patent: Feb. 14, 2017

(54) APPARATUS FOR AND METHOD OF WINDING-UP A METAL STRIP, AND PLANT FOR PRODUCING A METAL STRIP WINDABLE INTO A COIL

(71) Applicant: SMS Siemag AG, Duesseldorf (DE)

(72) Inventors: Thomas Fest, Pittsburg, PA (US); David A. Nold, Cranberry Township, PA (US); Heinz-Adolf Mueller, Wilnsdorf (DE); Christian Mengel, Siegen (DE)

(73) Assignee: SMS Group GmbH, Duesseldorf (DE)

( * ) Notice: Subject to any disclaimer, the term of this patent is extended or adjusted under 35 U.S.C. 154(b) by 225 days.

(21) Appl. No.: 14/096,476

(22) Filed: Dec. 4, 2013

(65) Prior Publication Data

US 2015/0151345 A1 Jun. 4, 2015

(51) Int. Cl.

| | |
|---|---|
| ***B21C 47/00*** | (2006.01) |
| ***B21C 47/08*** | (2006.01) |
| ***B21C 47/34*** | (2006.01) |
| *B65B 27/06* | (2006.01) |

(52) U.S. Cl.

CPC ..... *B21C 47/003* (2013.01); *B21C 47/3441* (2013.01); *B21C 47/08* (2013.01); *B21C 47/34* (2013.01); *B21C 47/345* (2013.01); *B65B 27/06* (2013.01)

(58) Field of Classification Search

CPC ..... C21D 9/68; B21C 47/146; B21C 47/10; B21C 47/003; B21C 47/08; B21C 47/345; B21C 47/3441

USPC ..... 72/146, 148; 29/283.5

See application file for complete search history.

(56) References Cited

U.S. PATENT DOCUMENTS 1,985,501 A * 12/1934 Hudson ..... B21C 47/08 261/DIG. 55
3,368,378 A * 2/1968 O'Brien ..... B21C 47/04 72/148
3,587,274 A * 6/1971 Rotter ..... B21C 47/063 72/148

(Continued)

FOREIGN PATENT DOCUMENTS

CA 1227673 A * 10/1987 ..... B21C 47/02
DE 10310399 A1 * 9/2004 ..... B21B 37/24

*Primary Examiner* — Joseph J Hail
*Assistant Examiner* — Arman Milanian
(74) *Attorney, Agent, or Firm* — Abelman, Frayne & Schwab

(57) ABSTRACT

An apparatus (1) for winding-up a metal strip (2) into a coil (3), includes a clamping pair (22) formed of a deflection roller (23) and a pressure roller (24) and located in front of the coil (3) in a material flow direction (10) so that the strip (2) is retained under tensional stress with respect to the coil (3) and is so bendable that the strip (2), which is provided with a corresponding pre-bend, is firmly wound into a coil (3). The apparatus further includes a first bending roller (35) pressable against the deflection roller (23), and arranged in front of the clamping pair (22) in the material flow direction (10), and a further roller (36) adjustable relative to the deflection roller (23) and arranged behind the clamping pair (22) in the material flow direction (10), with the pressure roller (24) and both bending rollers (35, 36) being so displaceable relative to the deflection roller (23) that an end region (45) of the strip (2) is additionally curved to form the pre-bend dependent on an end diameter (48) of the coil (3).

10 Claims, 10 Drawing Sheets

(56) References Cited

U.S. PATENT DOCUMENTS

Figure 1:
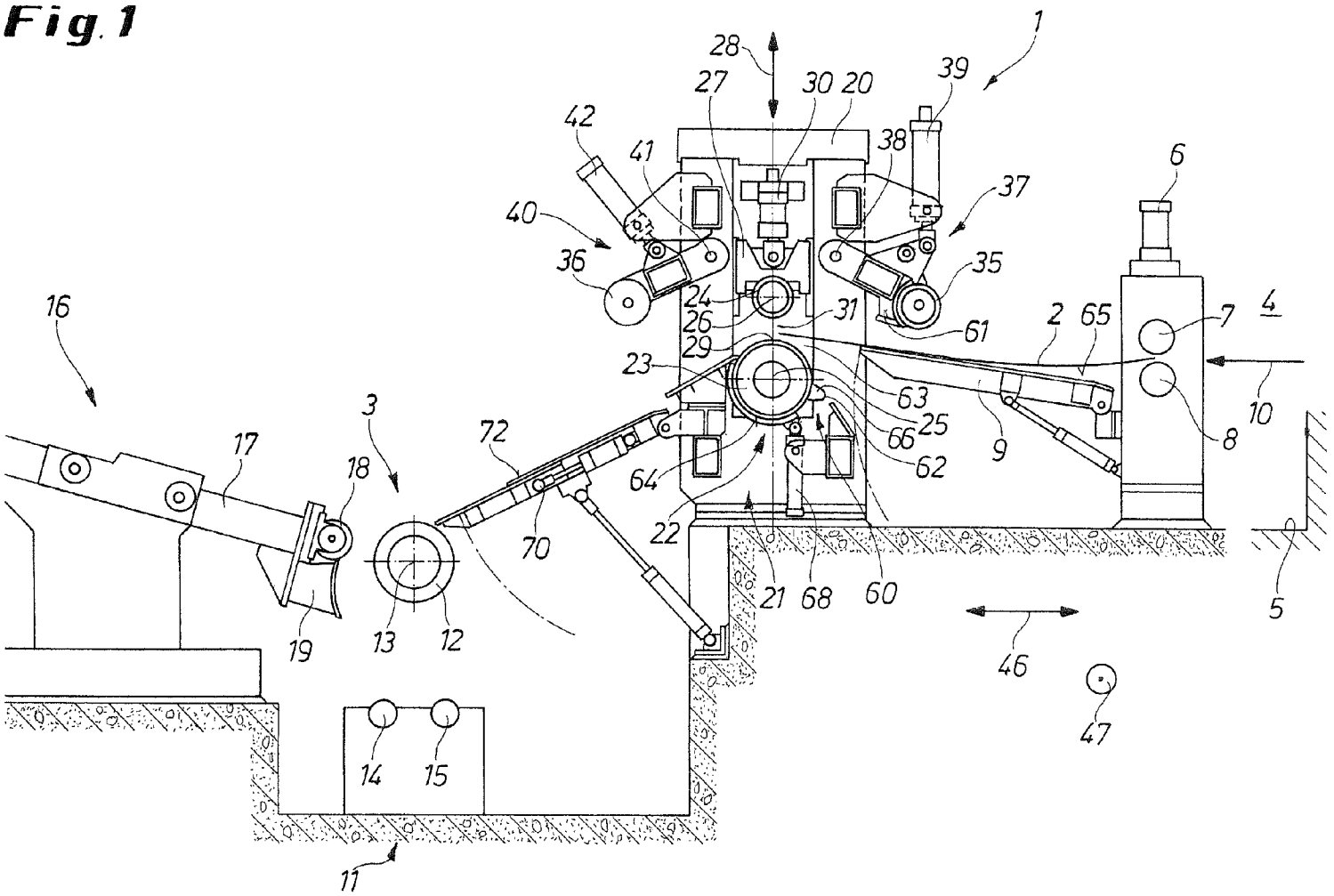

| | | | | | |
|---|---|---|---|---|---|
| 3,698,223 | A * | 10/1972 | Sagara | B01J 3/048 | 72/146 |
| 4,380,164 | A * | 4/1983 | Kuwano | B65H 19/28 | 242/534 |
| 4,463,586 | A * | 8/1984 | Griffin | B21B 38/02 | 242/534 |
| 5,361,618 | A * | 11/1994 | Stefanelli | B21D 5/14 | 72/146 |
| 6,039,283 | A * | 3/2000 | Munoz-Baca | B21C 47/34 | 242/531.1 |
| 6,301,946 | B1 * | 10/2001 | Kukizaki | B21C 47/003 | 72/10.2 |
| 6,305,068 | B1 * | 10/2001 | Sroka | B22D 11/1284 | 164/413 |
| 7,181,946 | B2 * | 2/2007 | Kruger | B21C 47/08 | 242/533.2 |
| 7,454,938 | B2 * | 11/2008 | Morel | B21C 47/063 | 242/533.6 |
| 8,096,157 | B2 * | 1/2012 | Mueller | B21C 47/04 | 242/535 |
| 8,353,190 | B2 * | 1/2013 | Hackenberg | B21B 38/02 | 72/12.3 |
| 8,555,476 | B2 * | 10/2013 | Cramer | B21C 47/24 | 242/363 |
| 2013/0071223 | A1 * | 3/2013 | Cramer | B21C 47/24 | 414/800 |
| 2013/0256439 | A1 * | 10/2013 | Cramer | B21C 47/326 | 242/363 |
| 2015/0151345 | A1 * | 6/2015 | Fest | B21C 47/3441 | 242/418 |

* cited by examiner

APPARATUS FOR AND METHOD OF WINDING-UP A METAL STRIP, AND PLANT FOR PRODUCING A METAL STRIP WINDABLE INTO A COIL

The invention relates to an apparatus for winding-up a metal strip into a coil and including a clamping pair formed of a deflection roller and a pressure roller and located in front of the coil in a material flow direction so that the strip is retained under tensional stress with respect to the coil and is so bendable that the strip which is provided with a corresponding pre-bend, is firmly wound into a coil.

In addition, the invention relates to apparatus for winding-up a metal strip into a coil and including a clamping pair for deflecting and pre-bending the strip between a rolling mill and the coil, wherein the clamping pair has a deflection roller rotatable about a rotational axis and means for pressing the strip against the deflection roller.

The invention further relates to a plant for producing a metal strip windable into a coil and including a hot rolling mill for rolling the metal strip and an apparatus for winding-up the metal strip into a coil.

Still further, the invention relates to a method of winding-up a metal strip into a coil according to which the strip is fed through a clamping pair, which is formed of a deflection roller and a pressure roller, to a coiler already in a pre-bending state and there is wound into a coil under a tensional stress, and according to which upon the strip reaching the end region of the strip, this end region is additionally curved so that the end region with its last windings particularly tightly nestles against the coil.

Subject apparatuses and methods for winding-up a metal strip into a coil are known from the state-of-the art for a long time. Generally, such a winding-up apparatus follows a hot rolling mill or another strip-treating installation in order to wind up the strip into a compact coil for transportation and further treatment purposes. As a rule, the winding-up takes place under tensile stress of the strip in order that the strip, upon being deflected by a deflection roller, is continuously bent and can be wound into the coil. During winding-up of a strip and, in particular, of a steel strip, the end region of the strip almost always presents a particular challenge. It lies, among others, in that the wound coil, because of inherent spring forces of a metal strip, has a tendency to bow in a spring-like manner, in particular, with regard to its last windings. This not only presents an increased risk of injury to the personal, but in addition, such a "spring-up" coil, generally, cannot be used any more and, therefore, should be dispensed with as waste. Further, a finished wound coil is additionally wrapped up with holding means, e.g., restraining belts or restraining bands in order to retain the wound shape and make it safe for planned transportation and further treatment purposes. In addition, the end region of a metal strip is often not suitable for process-related purposes because this end region of the strip is not deflected by a deflection roller under the tensile stress and cannot be lastingly pre-bent, wherein a respective length of this region is determined by the layout of a respective usable winding-up apparatus. Dependent on the material and thickness of the metal strip, the inherent spiral spring effect of a coil is pronounced to a greater or lesser degree. Thus, metal strips with a high strength, in particular, have a tendency to "spring up" after being wound. At lower strength and smaller thicknesses, the tendency to "spring up" is lower. Thus, a coil, which was wound at the end of a hot rolling mill at a still high temperature, after a subsequent processing step, e.g., after a pickling process, would be more difficult to handle with regard to its new winding. The difficulty consists in that after the cutting step for shortening the strip, the end edge of the strip is very sharp. This can lead during handling of the coil, to tear of the retaining means that should retain the shape of the wound coil. This also presents an increased danger of injury of the personnel and for further treatment.

For reducing the danger of "springing-up" of a wound coil, the state-of-the art discloses a member of measures which permit to further noticeably curve the end region of a metal strip in addition to the already undertaken pre-bend, which, in turn, insures that the windings of the end region abut the coil body substantially better, and the "spring-up" effect of the coil is less pronounced.

To prevent damage or even tear of the retaining means by the sharp end edge of the strip, the sharp end edge is often covered by a suitable object, so that the retaining means does not come into contact with the sharp edge right away.

E.g., the publication DE 10 2006 029 858 A1 discloses a method and an apparatus which permit to additionally curve the end region of the strip when the strip itself is not held any more under tensile stress, so that "springing-up" of the wound strip is prevented. According to the first embodiment, the additional curving is effected by displacement of an upper drive roller of a drive relative to a lower roller of the drive forward, in the rolling direction and, simultaneously, downwardly. A hold-down roller, which is located in front of the drive in the rolling direction and above the strip, prevents the strip from moving upward as a result of displacement of the upper drive roller. Thereby, altogether, three rollers introduce a corresponding bending torque in the end region of the strip and provide for corresponding additional curving of the end region. In two other embodiment described there, in addition to the drive rollers of the drive, a three-roller bending unit formed of three rollers, is provided, which can be located, in the rolling direction, in front of or behind the drive to provide for a corresponding additional curving of the strip end region.

The prior art devices for and methods of reducing the spring-up danger of a wound strip or coil are constructively very expensive and/or are insufficiently reliable.

Accordingly, the object of the invention is to improve the subject devices or at least to overcome the above-mentioned drawbacks.

The object of the invention is achieved with an apparatus for winding-up a metal strip into a coil and having features recited in claim 1.

The invention distinguishes from the state-of-the-art in that a first bending roller that is pressable against the deflection roller, is arranged in front of the clamping pair in the material flow direction and a further bending roller that is adjustable relative to the deflection roller, is arranged behind the clamping pair in the material flow direction and the pressure roller and both bending rollers are so displaceable relative to the deflection roller that an end region of the strip is additionally curved to form the pre-bend dependent on an end diameter of the coil.

The chosen construction successfully provides in a particular simple manner, an apparatus for winding-up, shortly, a winding-up apparatus with a deflection and bending device with which the strip, during winding-up, is first pre-bent, on one hand, and on the other hand, can additionally be further curved in its end region, in addition to the pre-bend.

The proposed construction was particularly successful in eliminating an additional three-roller device provided in front or behind the clamping pair for obtaining the additionally curved end region.

As a result of cooperation of both bending rollers with the deflection roller and the pressure roller, it became possible to introduce a bending torque which also produces a plastic deformation, in the end region of the strip transverse to the longitudinal direction of the strip, which permitted to additionally curve the end region of the strip.

State-of-the-art discloses that the strip end region can advantageously be additionally curved to prevent a "spring-effect" of a wound strip or coil. However, the present invention is characterized by a very simple construction, wherein with a selected arrangement of a single upstream and a single downstream bending roller which directly cooperate with the deflection roller and the pressure roller of the clamping pair, a particularly differentiated handling, with regard to the achievable curving of the strip end region, can be achieved.

The object of the invention is also achieved with a method of winding a metal strip into a coil and having features recited in claim 10.

The invention distinguishes from the subject state of the art in that for producing the additional curvature, a first roller, which is arranged in front of the clamping pair is pressed against the deflection roller and thereby the strip which is advanced between the first bending roller and the deflection roller, is pressed against a circumferential surface of the deflection roller, in that the pressure roller is lifted off the deflection roller, and in that a further roller which is located downstream of the clamping pair and is spaced from the deflection roller, interact with the strip, whereby an amount of the additional curvature of the end region is set by a relative positioning of the pressure roller and both bending rollers with respect to the deflection roller.

The amount of the additional curvature can be further advantageously modified by displacing the further roller toward or away from the deflection roller, dependent on how strongly the end region of the strip should be curved.

In addition, initially, the strip is held down by the further bending roller so that it can advantageously wind on the mandrel.

Within the meaning of the invention, the clamping pair, which consists of the deflection roller and the pressure roller, represents a deflection and bending device for the winding strip with which the strip can be fed to a coiler under the tensile stress so that finally it can be wound into the coil. The clamping roller pair so advantageously displaces the metal strip in the material flow direction that the deflection and bending device also represents a drive unit of the present winding-up apparatus and which is placed immediately in front of the coiler.

Basically, both the deflection roller and the pressure roller can be motor-driven, wherein the deflection roller preferably rotates about a stationary rotational axis, and the pressure roller is preferably linearly displaced with respect to the deflection roller so that the pressure roller can be adjusted relative to the deflection roller for clamping the strip between the deflection roller and the pressure roller. Meanwhile, an almost arbitrary operational gap can be formed between the deflection roller and the pressure roller with regard to the strip.

According to the invention, the first bending roller is so displaced relative to the deflection roller that eventually it contacts the deflection roller or is pressed there against in order to be able to clamp the strip, which is fed in the material flow direction therebetween. Here, however, the first bending roller does not contact the deflection roller at its apex, but rather a circumferential region that is located, in the material flow direction in front of the apex, on one hand, and beneath the apex, on the other hand. Thereby, the first bending roller enables, in cooperation with the pressure roller, curving, in particular, of the end region of the strip with a radius that substantially corresponds to the radius of the deflection roller in the circumferential direction. Advantageously, the first bending roller is displaceable along a first curve path.

The further bending roller is also so arranged that it is displaceable relative to the, in particular, is pivotable along a further curve path, whereby the strip is further displaced, in the material flow direction, downstream of the clamping pair and can be placed on the deflection roller to further modify the amount of the additional curvature of the end region.

The present winding-up apparatus can further be simplified when the apparatus has a frame on which the deflection roller stationary, the pressure roller linearly displaceably relative to the deflection roller and both bending rollers are mutually arranged pivotably relative to the deflection roller.

In addition, the object of the invention is achieved with an apparatus for winding-up a metal strip into a coil.

The invention distinguishes from the state-of-the art by a strip support member rotatable about the rotational axis of the deflection roller and having a bending edge about which a rear edge region of a strip end is foldable.

The undesirable spring-up effect of a previously wound-up coil can cumulatively or alternatively be reduced by folding or additionally bending the often sharp, rear edge region of the strip in such a way that the retaining means does not contact the sharp edge of the strip but rather contact only a curved surface of the edge region of the strip. Thereby, the danger of the retaining means being damaged or completely be torn, as occurs in the state-of-the-art, is excluded.

In this respect, according to a further embodiment of the inventive method, it is contemplated to fold the rear edge region of the end region of the strip about a bending edge of a strip support member displaced in a circumferential direction of the deflection roller and positioned beneath the strip, by a pivotable strip bending part arranged above the strip.

It should be understood that means for pressing the strip against the deflection roller can constructively be formed differently. However, constructively, the simplest way is to form the pressing means as a pressure roller that, together with the deflection roller, form the clamping pair of the deflection and bending device. Thereby, construction costs can be noticeably reduced, as the pressure roller normally is already available.

It should be further understood that the strip support member can be likewise differently formed. If strip support member has a bending peg, the strip support member can be advantageously arranged between the circumferential surface of the deflection roller and the strip surface facing the deflection roller.

Constructively, the apparatus can be further simplified when the deflection roller and the strip support member have a common rotational axis. Thereby, it becomes possible to make the strip support member displaceable along the circumference of the deflection roller.

The strip support member can be driven by hydraulic cylinder means or by another motor means.

It is further advantageous when there is provided a strip bending member pivotable relative to the deflection roller and the strip support member and arranged on a holding arm of a bending roller pressable against the deflection roller.

With the strip bending member, the edge region of the strip can be folded or bent over the strip support member.

This bending roller is arranged, in the material flow direction, in front of the deflection roller. It is further advantageous when the strip support member is arranged in front of the deflection roller in a material flow direction in order to be able to process the edge region when the strip is clamped between the coiler and the clamping pair.

The processing forces which act on the strip support surface and which are produced by the strip bending member can be particularly good absorbed by the apparatus when the strip support member is so arranged relative to the deflection roller that is supportable against the apparatus during folding over a circumferential surface of the deflection roller.

The strip support member is held at a distance from the deflection roller by a spring force or the like so that it is freely movable. This can be carried out, e.g., with a correspondingly arranged plate spring. A correspondingly arranged spring element presses the strip support member away from the deflection roller, enabling support of the strip support member against the deflection roller when the corresponding processing forces act on the strip support surface.

The object of the invention is also achieved with a plant for producing a metal strip windable in a coil and having features of claim 9, the plant being characterized in that it comprise a strip treatment installation for treating the metal strip and an apparatus for winding-up the metal strip into a coil, and at least one of the apparatuses for winding-up the metal strip according to one of the discussed features.

Advantageously, with the proposed apparatuses, reinforced metal strips, in particular, can be wound into a coil reliably and very good.

It should be understood that the features of the proposed or described in the claims solutions can be combined, if needed, to be able to cumulate the corresponding advantages.

It should point out that a strip processing installation or a strip handling installation, e.g., a rolling mill or a hot rolling mill, can also be a push-pull-pickle line or the like.

Further feature, effects, and advantages of the invention will be explained with reference to the following description and the drawings which show and describe an apparatus for and a method of winding a metal strip into a coil.

IN THE DRAWINGS

FIGS. 1 through 17 schematically show the technological process of a likewise schematically shown, in a side view, of the inventive apparatus for winding-up a metal strip which is provided at an output region, e.g., of a hot rolling mill and has a deflection device, a bending device, a winding device, and a strip feeding device.

FIGS. 1 through 17 show an embodiment of an apparatus 1 for winding-up a metal strip 2 in a coil 3 (see in particular FIG. 4), wherein FIGS. 1 through 17 illustrate a possible first technological process for winding a metal strip 2.

At an output region 4, e.g., of a hot rolling mill 5, the strip 2 is fed to the apparatus 1 for winding-up or a winding-up apparatus 1 by a feeding device 6. However, the winding-up apparatus 1 can also be provided downstream of another installation for treating the strip 2. Anyway, the feeding device 6 includes two feeding rollers 7 and 8, a pivotal feeding arm 9 which is so arranged that the fed strip is reliably delivered to the winding-up apparatus 1 in the material flow direction 10.

Downstream of the winding-up apparatus 1, there is provided a coiler 11 which can provide a mandrel 12 on which the strip 2 can finally be wound up in a coil 3. The mandrel 12 is supported for rotation about axis 13. Beneath the mandrel, there are provided two support rollers 14 and 15 for supporting the coil 3. The coiler 11 includes, in addition to the mandrel 12, an infeed device 16 having a telescopic infeed arm 17 with which a roller member 18 and a deflection plate 19 can be advanced toward the coil 3 and apply pressure thereto.

The winding-up device 1 itself has a central frame 20 located between the feeding device 6 and the coiler 11.

The winding-up apparatus 1 includes a deflection and bending device 21 formed by a clamping roller pair 22 (See FIGS. 1 through 3), wherein the clamping roller pair 22 has a deflection roller 23 and a pressure roller 24 arranged thereabove. Both the deflection roller 23 and the pressure roller 24 are supported in the frame 20, wherein the deflection roller 23 rotates about a stationary axle 25.

The pressure roller is rotatable about a displaceable vertical rotational axis 26, wherein the pressure roller 24, together with its rotational axis 26, are supported in the frame 20 for linear displacement in a vertical direction 28 by a slide member 27.

A correspondingly directed setting movement applied to the upper apex 29 of the deflection roller 23, is carried out by a pressure roller hydraulic cylinder 30 which is secured in the frame 20 above the pressure roller 34 or the deflection roller 23.

The deflection roller 23, in this embodiment, is driven by a driving device (not shown) so that it can rotate in a counter-clockwise direction.

In the view shown in FIG. 1, the pressure roller 24 is displaced in an upper initial position so that a maximal gap 31 is formed between the pressure roller 24 and the deflection roller 23. In this phase, the winding-up device 1 feeds the strip 2 with the pivotal feeding arm 9 according to the material flow direction to initiate a winding-up process of the strip 2, as it will be explained further.

The winding-up device 1 is characterized not only by the clamping roller pair 22. Rather, it also includes a first bending roller 35 that is arranged, in the material flow direction 10, in front of the clamping roller pair 22, and a further bending roller 36 that is positioned, in the material flow direction 10, behind the clamping roller pair 22.

The first bending roller 35 is mounted on the frame 20 for pivotal movement by a front pivot arm 37 about a front pivot axis 38. The front pivot arm 37 is secured to a piston member of a front hydraulic cylinder 39 that provides for pivotal movement of the front pivot arm 37 and, thereby, for the first bending roller 35 about the front pivot axis 38. The front hydraulic cylinder 39 is secured on the frame 20 with its cylindrical member.

Correspondingly, the further bending roller 36 is supported on the frame 20 for pivotal movement about a rear pivot axis 41 by a rear pivot arm 40. For the pivotal movement of the rear pivot arm 40 and, thereby, of the further bending roller 36 about the rear pivot axis 41, there is provided a rear hydraulic cylinder 42 which is likewise secured on the frame 20 with its cylindrical member and has its piston member attached to the rear pivot arm 40.

According to the invention, the bending rollers 35, 36 which are provided in the winding-up apparatus 1, and are located, with respect to the clamping roller pair 22 which consists of the deflection roller 23 and the pressure roller 24, in front of the clamping roller pair 22 and behind the clamping roller pair 22, respectively, are supported on the common frame 20, whereby the pressure roller 24 and both bending rollers 35 and 36 are so displaceably arranged with respect to the deflection roller 23 that in an end region 45 (see in particular FIG. 6), additionally, a bending torque 47 can be introduced which acts transverse to a longitudinal direction 46 of the strip 2 and produces plastic deformation. Thereby, the end region 45 can be curved additionally to the already produced preliminary bending, ideally, dependent on the end diameter 48 (shown only in FIG. 17).

Advantageously, the deflection roller 23 and the pressure roller 24 of the clamping roller pair 22 and both bending rollers 35, 36 are compactly arranged in the common frame 20 of the wind-up apparatus 1. Thereby, it became possible to provide a very compact deflection and bending device 21 on the basis of the clamping roller pair 22, which permitted, e.g., to eliminate an additional three-roller bending machine in front of the clamping roller pair 22 or behind the clamping roller pair 22.

For folding the edge region 59 (see FIG. 6), the winding-up apparatus 1 includes a strip support member 60 rotatable about the rotational axis 25 of the deflection roller 23 and which can be so displaced below the strip 2 that the strip 2 can be correspondingly folded by a strip bending member 61 provided above the strip 2.

Advantageously, the strip support member 60 has a bending rim 62 over which the strip 2 can be precisely folded with the pivotal strip bending member 61.

The strip support member 60 can advantageously be arranged in an intermediate space 63 between the curved circumferential surface 64 of the deflection roller 23 and the bottom side 65 of the strip 2 when the strip support member 60 includes a bending peg 66.

The strip bending member 61 can constructively particularly simply integrated in the winding-up apparatus when it, as it is realized in the discussed embodiment, is arranged on the front pivot arm 37, e.g., extends from the front pivot arm 37.

Because the strip support member 60 can pivot about the rotational axis 25 of the deflection roller 23, there is provided, beneath the deflection roller 23, a cylinder 68 for the strip support member 60 secured, on one hand, to a corresponding element of the strip support member 60, and on the other hand, to the frame 20.

In the embodiment shown in FIG. 1, the finished strip 2, e.g., the rolled pickled strip 2, or the like, is so fed to the clamping roller pair 22 by the feeding device 6 and the pivotal feeding arm 9 that it can be advanced with its front edge through the maximal gap 31. During this phase, both bending rollers 35, 36 are located in their upper position and do not take part in the production process. Also, the strip support member 60 is still in a lower initial position.

To be able to purposefully feed the strip 2 to the mandrel 12 during further processing, an arm 70 is so positioned between the winding-up apparatus 1 and the coiler 11 that the strip 2 can be reliably advanced to the mandrel 12.

Figure 2:
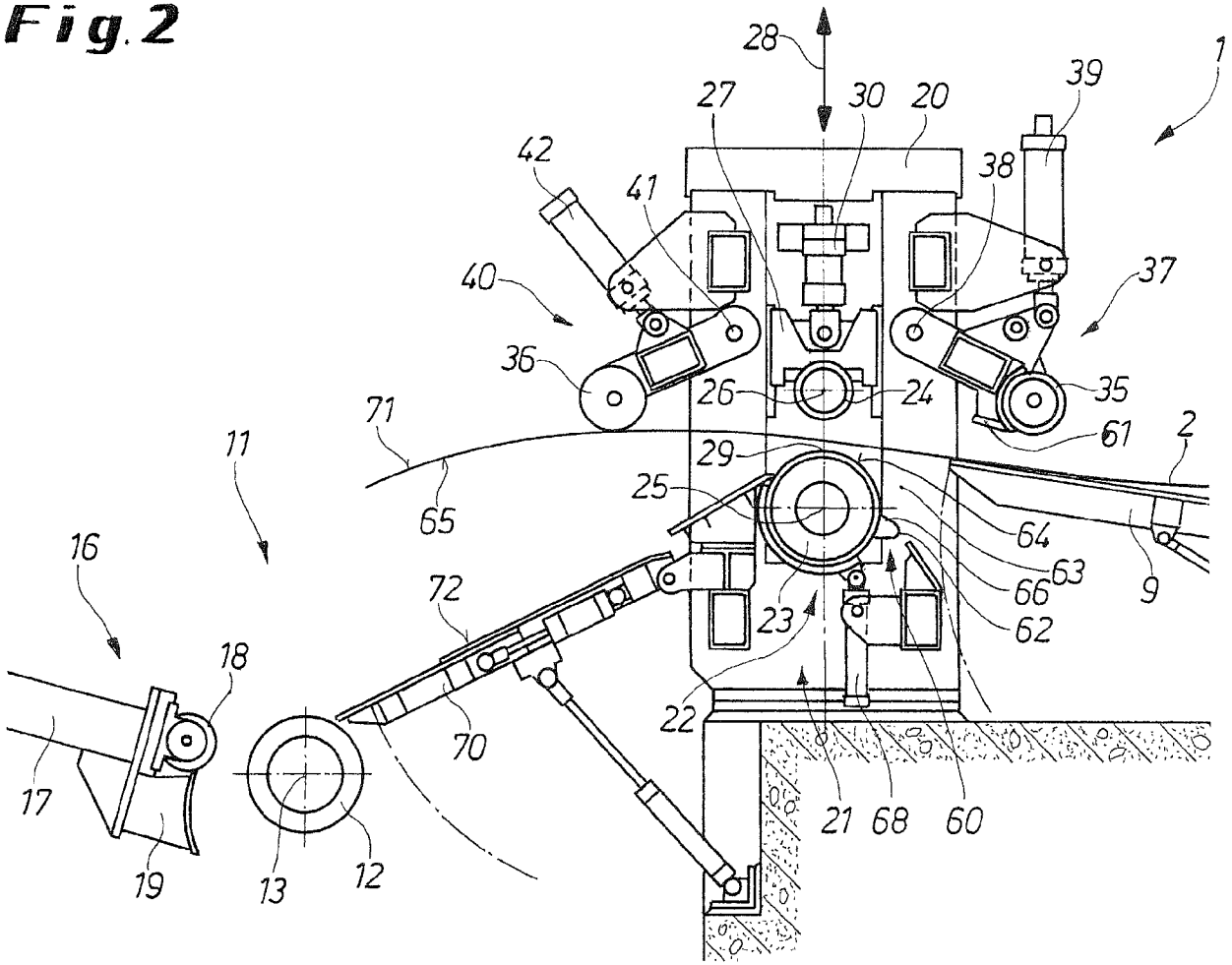

As shown in FIG. 2, the strip 2 is further pushed through the maximal gap 31 and, due to its inherent stiffness, contacts with its upper surface 71 the further bending roller 36 that is still located in its upper initial position.

Figure 3:
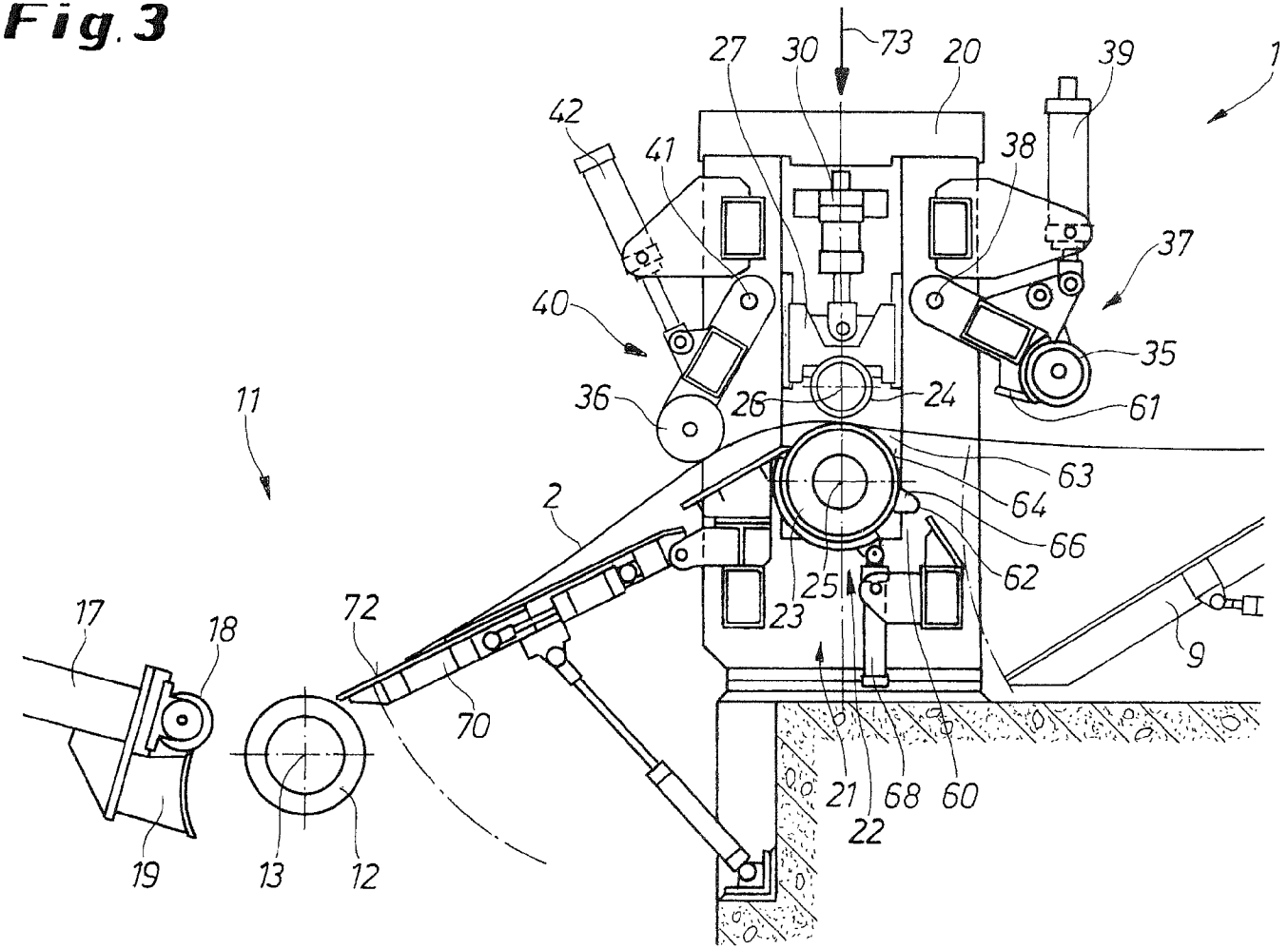

As shown in FIG. 3, the further bending roller 36 meantime pivots toward the deflection roller 23 so that the strip 2 lies with its front region and particularly with its front edge on the smooth surface 72 of the arm 71. In this phase, the pressure roll 24 advances toward the deflection roller 23 in vertical direction 28 according to pressure direction 73, so that the maximal gap 31 is correspondingly reduced. Furthermore, the pivotal feeding arm 9 of the feeding device 6 pivots downwardly in a lower position so that it does not any more interact with the bottom side 65 of the strip 2.

Figure 4:
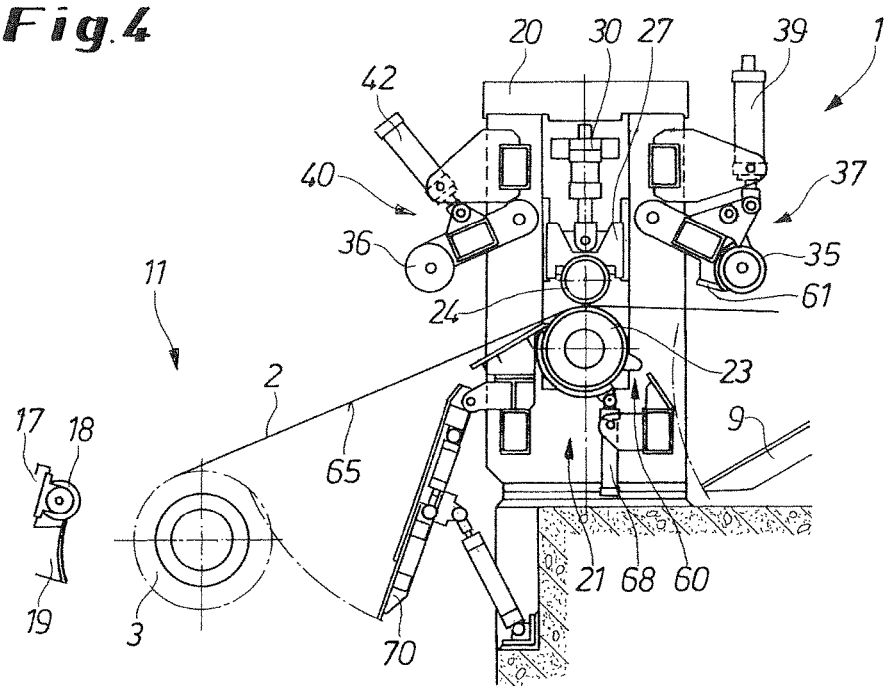
Figure 5:
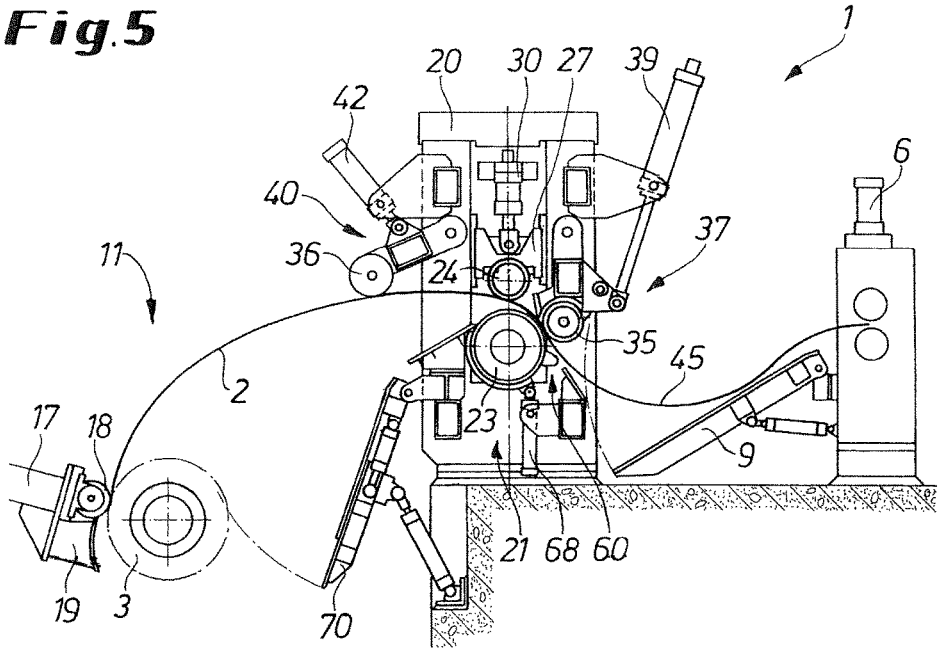

As shown in FIG. 4, the pressure roller 24 is so pressed against the deflection roller 23 that the strip 2 is clamped between both rollers 23 and 24. In this position the strip 2 is already wound in the coil 3 on the mandrel 12 under tensile stress so that the coil windings tightly lay one over the other. During this phase, the arm 70 is pivoted into a lower position so that it does not any more interact with the bottom side 65 of the strip 2. The further bending roller 36 is again displaced in its upper initial position As shown in FIG. 5, the strip 2 is so wound into the coil 3 that its end region 45 reached the winding-up device 1. In order to curve only the end region 45 dependent on the end diameter 48 (see FIG. 17) of the coil 3, while an additional bending torque 47 is applied thereto, the first bending roller 35 is so set up on the circumferential surface 64 of the deflection roller 24 that the strip 2 has, between the apex 29 of the deflection roller 23 and the first bending roller 35, the same radius as the circumferential surface 64 of the deflection roller 23 and is correspondingly additionally curved. With this, the pressure roller 24 is somewhat lifted from the deflection roller 23 so that the strip 2 contacts, with its end region 45, the further bending roller 36 that still remains in its upper initial position. In order that the strip 2, during this phase in which the end region 45 is not wound any more under the tensile stress, can still be tightly wound on the coil 3, the roller 18, which meantime is advanced by the infeed arm 17 of the infeed device 16 toward the coil 3, presses the strip 2 against the winding of the coil 3.

Figure 6:
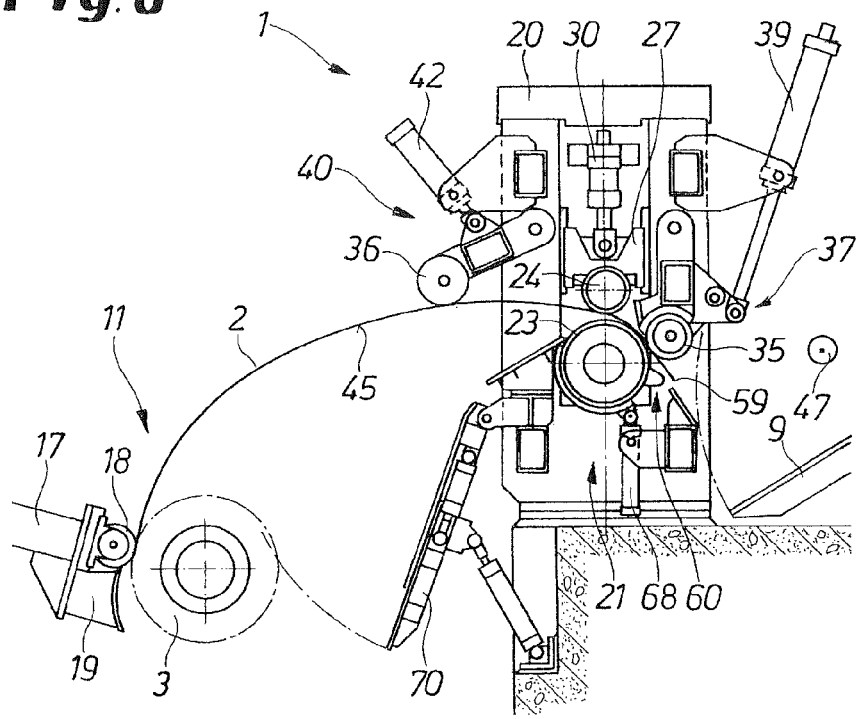

As shown in FIG. 6, the strip 2 is so advanced forward in the material flow direction that the rear edge region 59 of the strip 2 has reached the deflection roller 23. During this phase, the forward movement of the strip 2 in the material flow direction 10 is stopped in order to fold the rear edge region 59.

Figure 7:
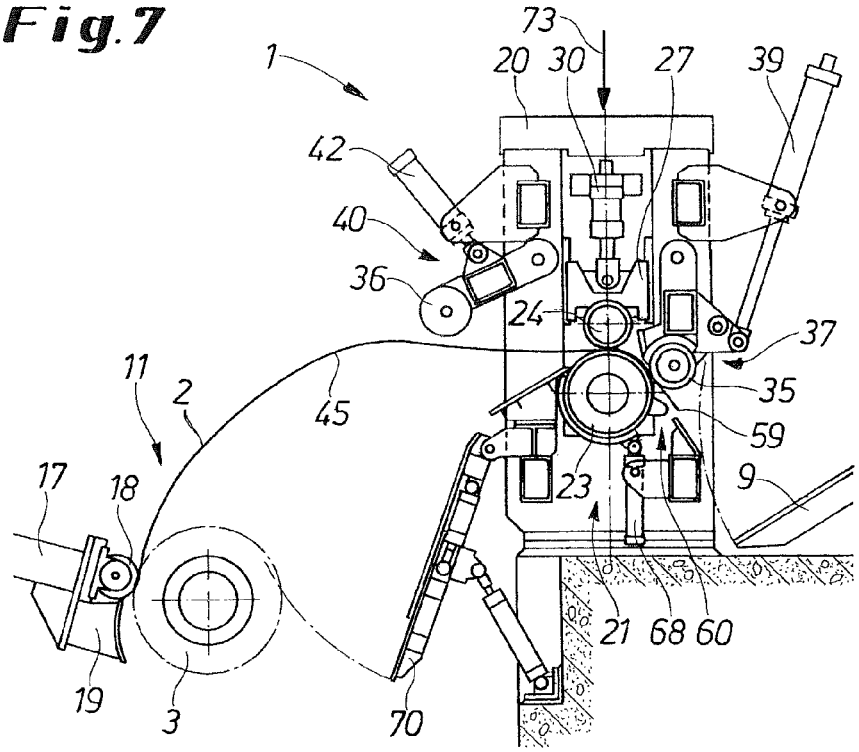

As shown in FIG. 7, to this end, the pressure roller 24 is against advanced toward the deflection roller 23 in the pressure direction 73 until the strip 2 is fixedly clamped between the apex 29 of the deflection roller 23 and the pressure roller 24. Here, only the end region 45 between the pressure roller 24 and the first bending roller 35 lies on the circumferential surface 64 of the deflection roller 23.

Figure 8:
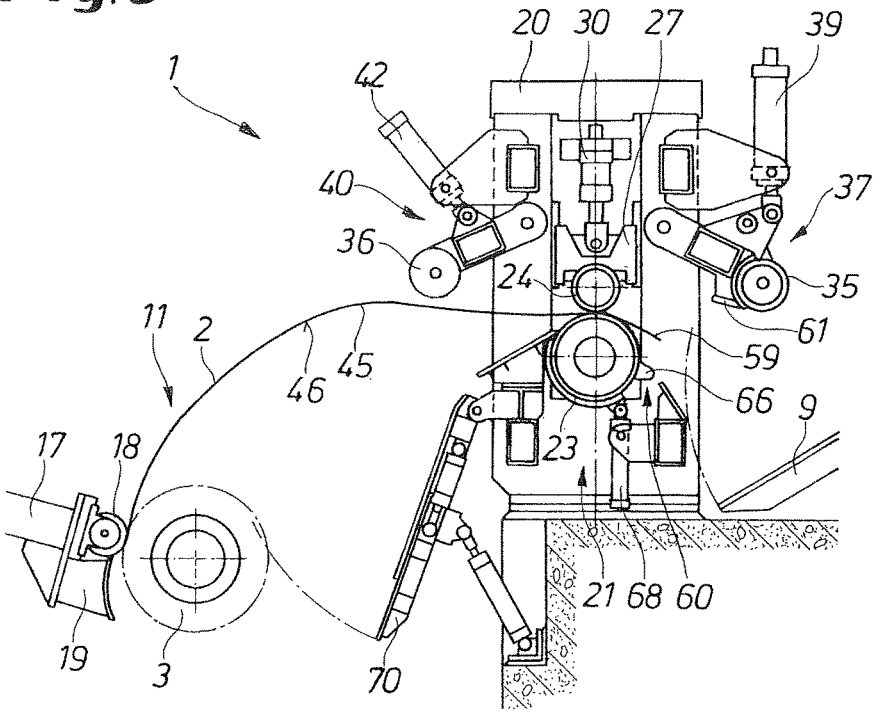
Figure 9:
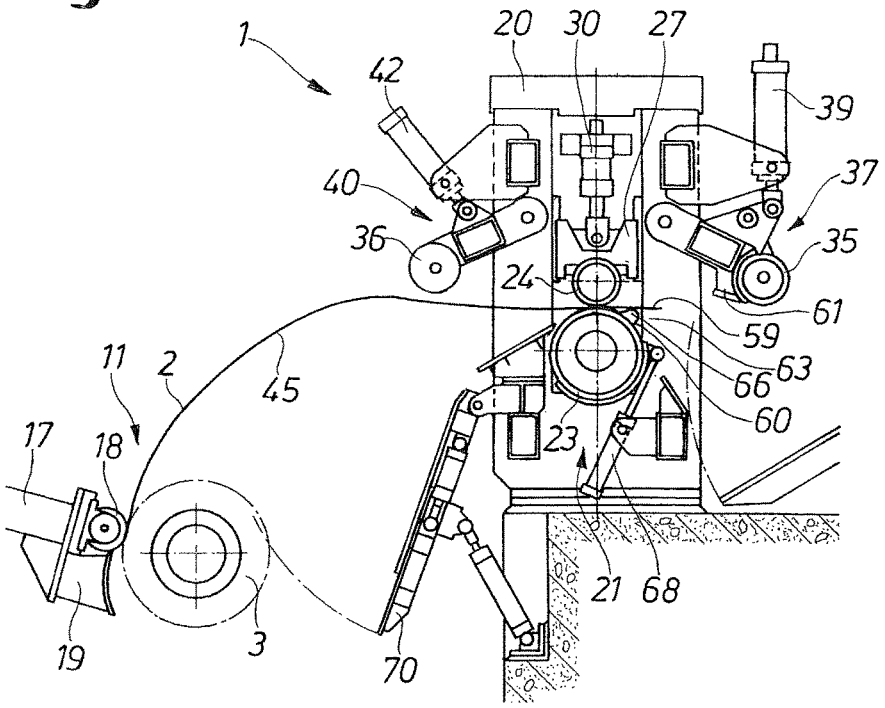

As shown in FIG. 8, the first bending roller 35 is pivoted back into its upper initial position, whereby the rear edge region 59 again is lifted off the circumferential surface 64 of the deflection roller 23 and becomes correspondingly spaced from the deflection roller 23. During this phase, only folding of the rear edge region 59 starts, while the strip bearing section 60 is displaced from its lower initial position in its upper bending position by a strip bearing cylinder 68 (see FIG. 9). Thereby, the rear edge region 59 is aligned almost horizontally between the clamping pair 22 and additionally lies on the strip bearing section 60.

Figure 10:
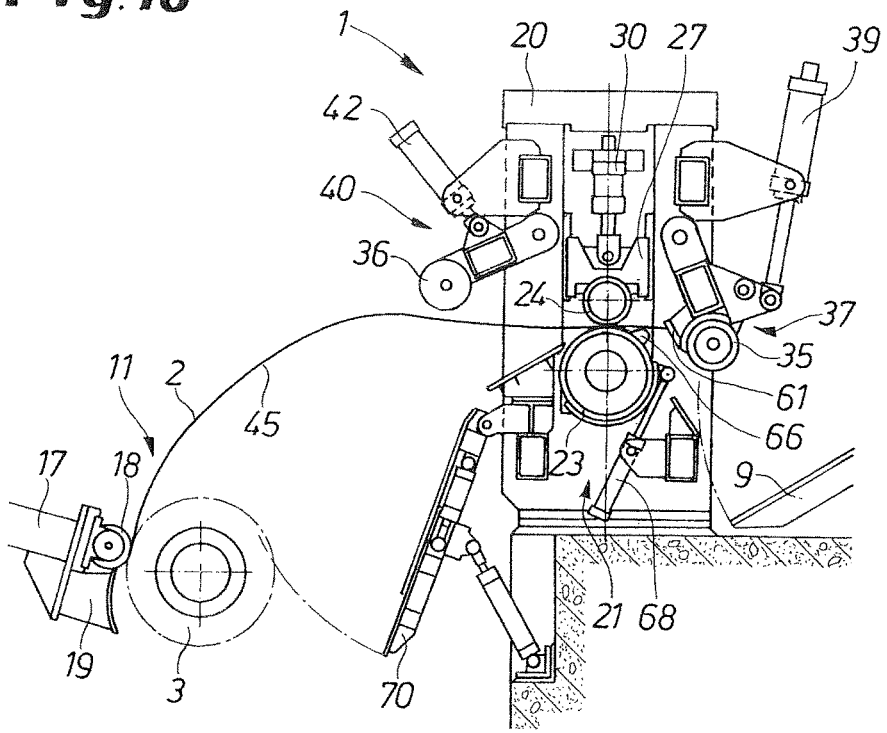
Figure 11:
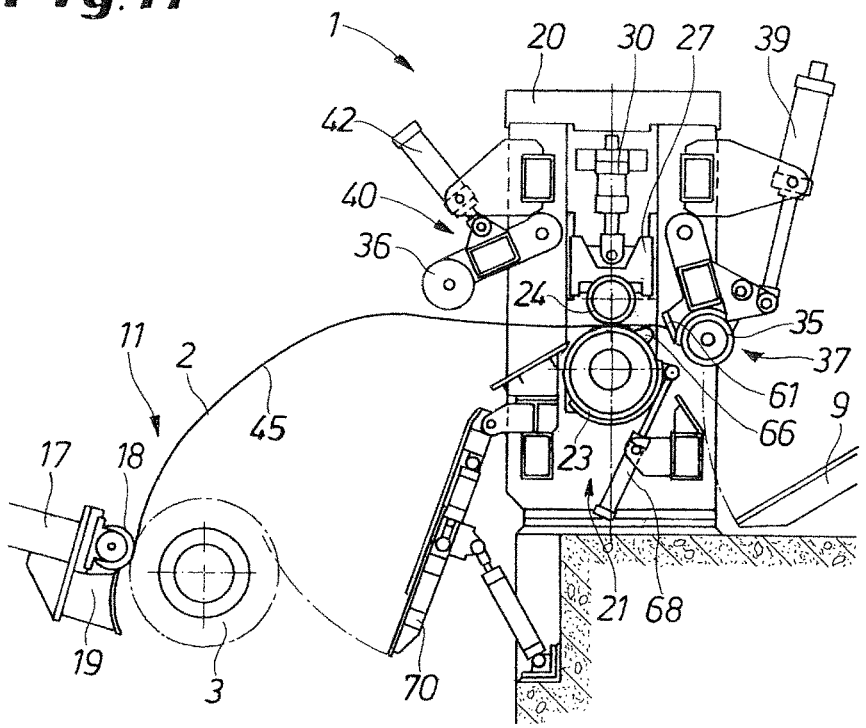

As shown in FIG. 10, only the front pivot arm 37 is so adjusted with respect to the deflection roller 23 and is so pivoted toward the deflection roller 23 that a strip bending part 61, which is provided on the bending arm 37, folds the rear edge region 59 over the bend rim 62, as clearly shown in FIG. 11.

Figure 12:
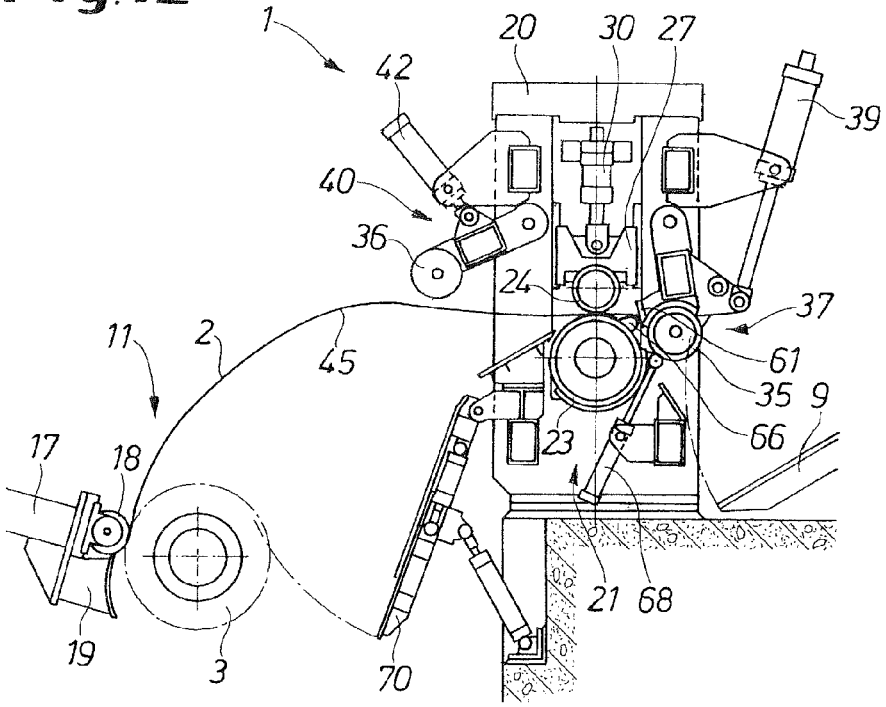

As shown in FIG. 12, the strip bending part 61 has reached its strip folding position in which the rear edge region 59 is maximally folded about the bend rim 62 in the desired manner.

Figure 13:
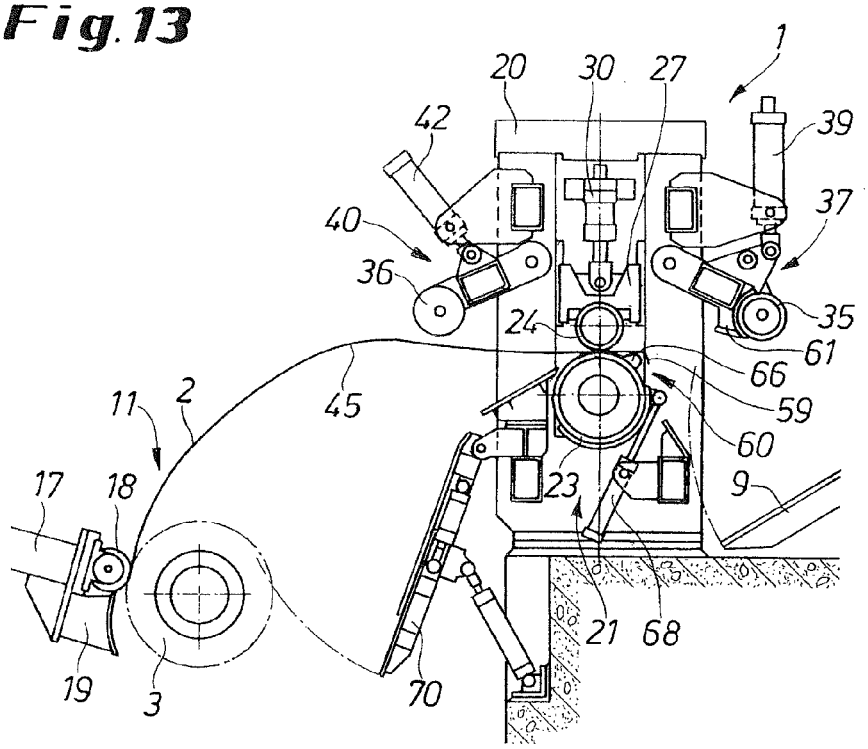

As shown in FIG. 13, the front pivot arm 37 is again pivoted back into its initial position. Thereby, the folding of the strip 2 in its rear edge region 59 is clearly seen.

Figure 14:
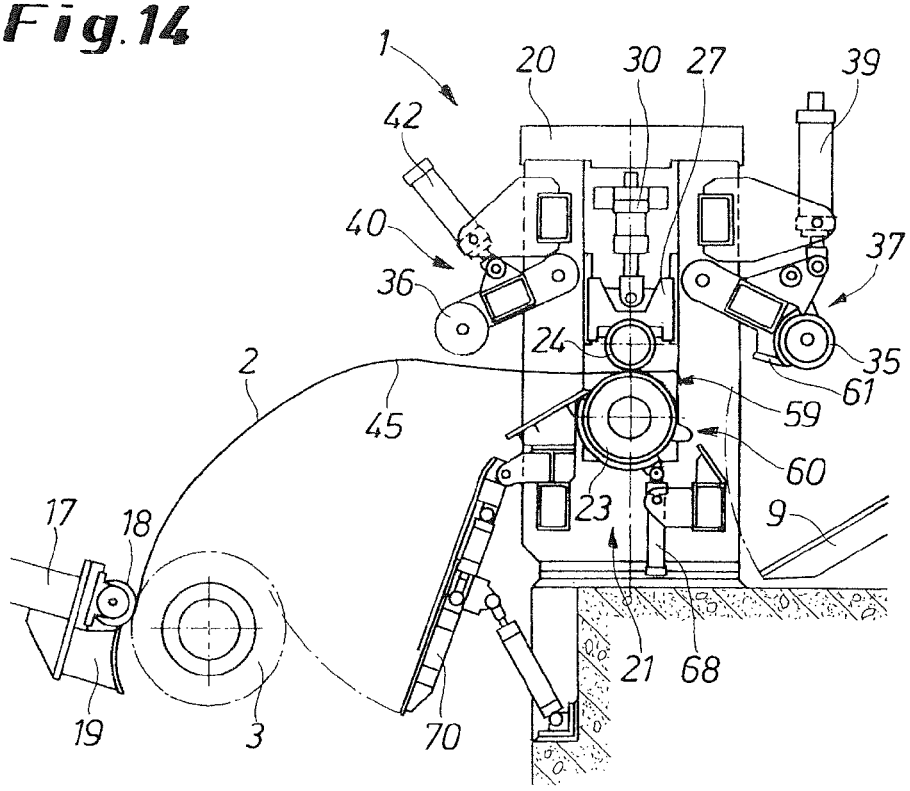
Figure 15:
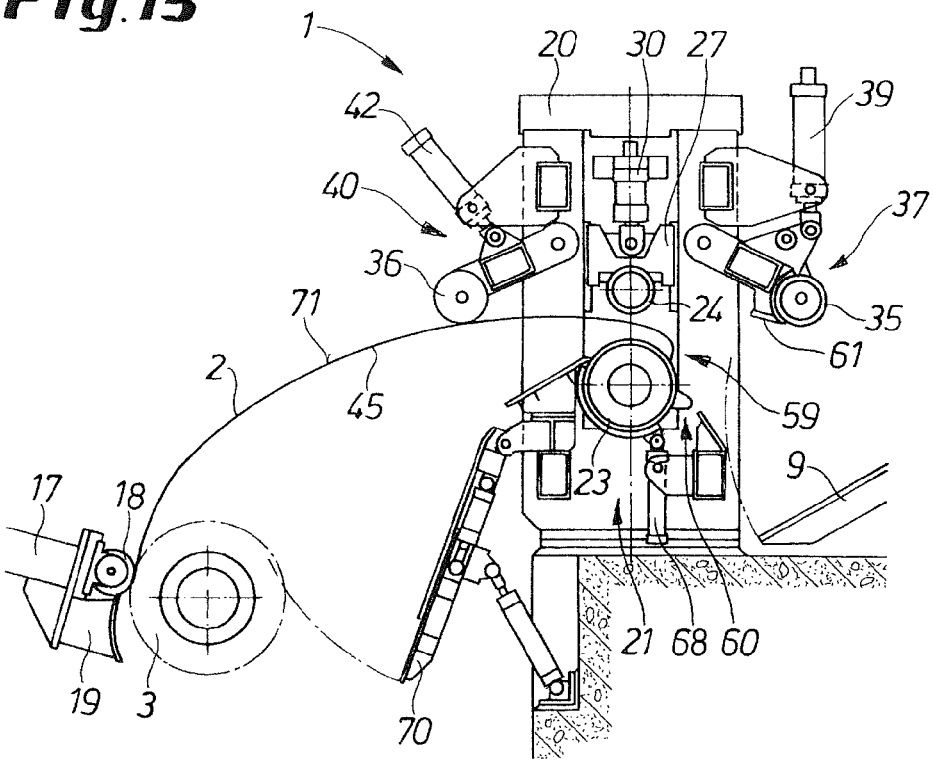

As shown in FIG. 14, the strip bending part 60 likewise is displaced in its lower initial position so that the rear folded edge region 59 is freely positioned in front of the deflection roller 23. During this phase of treatment, the clamping pair 22 is still firmly clamped so that the strip 2 between the clamping pair 22 and the roller member 18 is firmly clamped against the coil 3.

In order for the folded rear edge region 59 to pass the clamping pair 22 so that it can leave the winding-up device 1, the pressure roller 24 is again lifted off the deflection roller 23 and is displaced upwardly, so that the maximal gap 31 becomes again available between the pressure roller 24 and the deflection roller 23. In this way, the end region 45 of the strip 2 again bears against the further bending roller 36, without a load applied thereto, and is held down by the further bending roller 36 (see FIG. 15).

Figure 16:
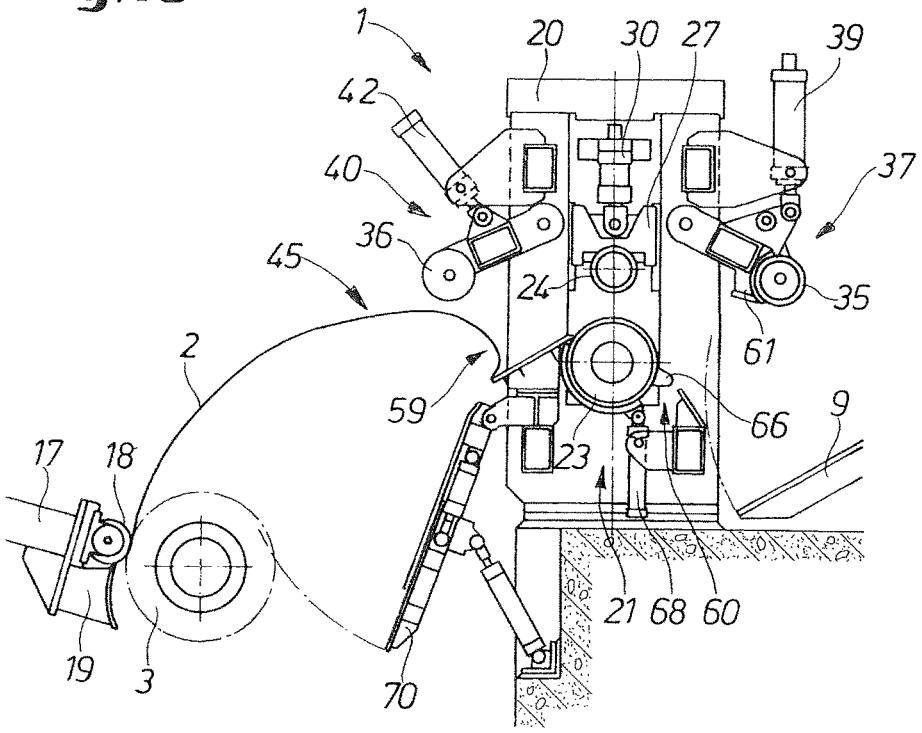

Finally, the so treated end region 45 is further wound on the coil 3, as clearly shown in FIG. 16. As can also be seen, the rear edge region 59 of the strip 2 is strongly curved.

Figure 17:
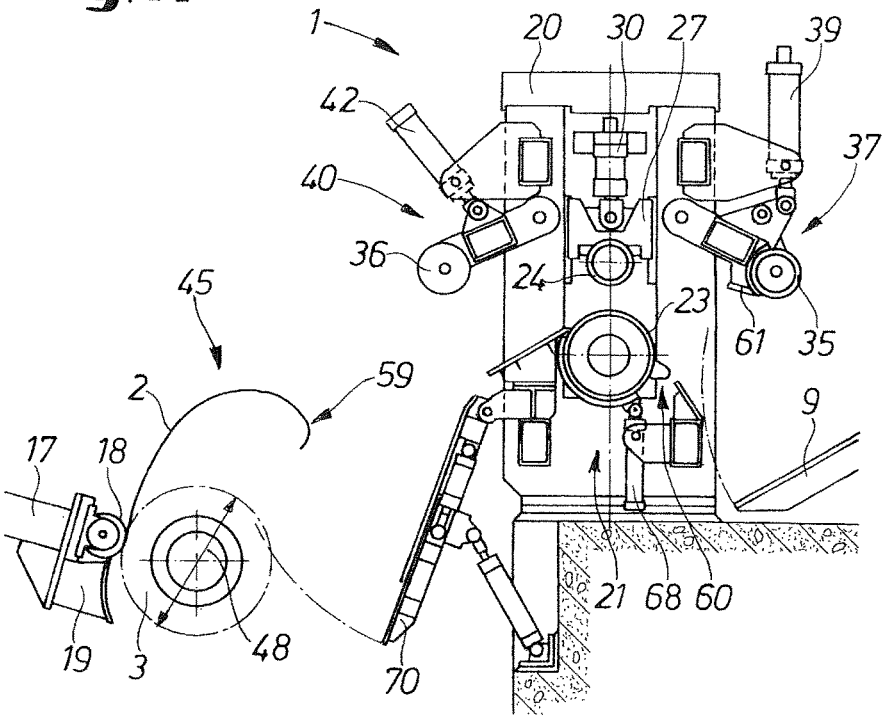

As clearly shown in FIG. 17, the end region 45 is wound on the coil 3 in such a way that the sharp rear edge of the rear edge region 59 does not present any danger for holding means subsequently wound about the coil 3.

It is explicitly stated that the foregoing features which are claimed in the claims and/or the solutions described with reference to the figures, can be, if needed, combined to increase the effect and advantages or to be able to obtain the same.

It should be understood that the above-described embodiment represents a first embodiment of the inventive winding-up apparatus 1. In this regard, the present invention is not limited by this embodiment.

Generally, the features described in the application are claimed as inventive as long as they are new with respect to the state of the art whether taken alone or in combination.

LIST OF REFERENCE NUMERAL

1 Winding-up apparatus
2 Strip
3 Coil
4 Output
5 Hot rolling mill or a similar installation for a strip product or handling
6 Feeding device
7 First feeding roller
8 Second feeding roller
9 Pivotal feeding arm
10 Material flow direction
11 Coiler
12 Mandrel
13 Rotational axis
14 First support roller
15 Second support roller
16 Infeed device
17 Infeed arm
18 Roller member
19 Deflection plate
20 Frame
21 Deflection and bending device
22 Clamping pair
23 Deflection roller
24 Pressure roller
25 Stationary rotational axis
26 Displaceable rotational axis
27 Slide member
28 Vertical direction
29 Upper apex
30 Hydraulic cylinder for the pressure roller
31 Maximal gap
35 First bending roller
36 Further bending roller
37 Front pivot arm
38 Front pivot axis
39 Front hydraulic cylinder
40 Rear pivot arm
41 Rear pivot axis
42 Rear hydraulic cylinder
45 End region
46 Longitudinal direction
47 Bending torque
48 End diameter
59 Rear edge region
60 Strip support member
61 Strip bending member
62 Bending edge
63 Intermediate arm
64 Circumferential surface
65 Bottom side
66 Bending peg
68 Cylinder for the strip support member
70 Arm
71 Upper side
72 Smooth surface
73 Pressure direction

The invention claimed is:

1. An apparatus (1) for winding-up a metal strip (2) into a coil (3), comprising a clamping pair (22) formed of a deflection roller (23) and a pressure roller (24) and located in front of the coil (3) in a material flow direction (10) so that the strip (2) is retained under tensional stress with respect to the coil (3) and is so bendable that the strip (2), which is provided with a corresponding pre-bend, is firmly wound into a coil (3), characterized in that a first bending roller (35) that is pressable against the deflection roller (23), is arranged in front of the clamping pair (22) in the material flow direction (10) and a further bending roller (36) that is adjustable relative to the deflection roller (23), is arranged behind the clamping pair (22) in the material flow direction (10), wherein the pressure roller (24) and first and further bending rollers (35, 36) are so displaceable relative to the deflection roller (23) that an end region (45) of the strip (2) is additionally curved to form the pre-bend dependent on an end diameter (48) of the coil (3).

2. An apparatus (1) according to claim 1, characterized by a common frame (20) on which the deflection roller (23) stationary, the pressure roller (24) linearly displaceably, relative to the deflection roller (23), and first and further bending rollers (35, 36) pivotably relative to the deflection roller (23), are mutually arranged.

3. An apparatus for winding-up a metal strip (2) into a coil (3), comprising a clamping pair (22) for deflecting and pre-bending the strip between a strip treatment installation (5) and the coil (3), wherein clamping pair (22) has a deflection roller (23) rotatable about a rotational axis (25) and means (24) for pressing the strip (2) against the deflection roller (23), characterized by a strip support member (60) rotatable about the rotatable axis (25) of the deflection roller (23) and having a bending edge (62) about which a rear edge region (59) of a strip end is foldable.

4. An apparatus according to claim 3, characterized in that the strip support member (60) comprises a bending peg (66).

5. An apparatus according to claim 3, characterized in that the deflection roller (23) and the strip support member (60) have a common rotational axis (25).

6. An apparatus according to claim 3, characterized by a strip bending member (61) pivotable relative to the deflection roller (23) and the strip support member (60) and arranged on a holding arm (37) of a bending roller (35) pressable against the deflection roller (23).

7. An apparatus according to claim 3, characterized in that the strip support member (60) is arranged in front of the deflection roller (23) in a material flow direction (10).

8. An apparatus (1) according to claim 3, characterized in that the strip support member (60) is so arranged relative to the deflection roller (23) that it is supportable against the apparatus (1) during folding over a circumferential surface (64) of the deflection roller (23).

9. A method of winding-up a metal strip (2) into a coil, comprising the steps of:

providing an apparatus (1) for winding-up a metal strip (2) into a coil (3), and having a clamping pair (22) formed of a deflection roller (23) and a pressure roller (24) and located in front of the coil (3) in a material flow direction (10) so that the strip (2) is retained under tensional stress with respect to the coil (3) and is so bendable that the strip (2), which is provided with a corresponding pre-bend, is firmly wound into a coil (3), a first bending roller (35) that is pressable against the deflection roller (23), is arranged in front of the clamping pair (22) in the material flow direction (10), and a further bending roller (36) that is adjustable relative to the deflection roller (23), is arranged behind the clamping pair (22) in the material flow direction (10), wherein the pressure roller (24) and first and further bending rollers (35, 36) are so displaceable relative to the deflection roller (23) that an end region (45) of the strip (2) is additionally curved to form the pre-bend dependent on an end diameter (48) of the coil (3);

feeding the strip (2) through the clamping pair (22) to a coiler (11) already in the pre-bend state and winding the strip (2) into a coil (3) under a tension stress, wherein upon the strip (2) reaching an end region (45) of the strip (2), the end region (45) is additionally curved so that the end region (45) with its last windings particularly tightly nestles against the coil (3);

pressing the first bending roller (35) against the deflection roller (23) and thereby the strip (2) which is advanced between the first bending roller (35) and the deflection roller (23), whereby the strip (2) is pressed against a circumferential surface (64) of the deflection roller (23);

lifting the pressure roller (24) off the deflection roller (23) so that the further bending roller (36) interacts with the strip (2), whereby an additional curvature is produced and an amount of the additional curvature of the end region (45) is set by a relative positioning of the pressure roller (24) and the first and second bending rollers (35, 36) with respect to the deflection roller.

10. A method according to claim 9, further comprising the step of folding a rear edge region (59) of the end region (45) of the strip (2) about a bending edge (62) of a strip support member (60) displaced in a circumferential direction of the deflection roller (23) and positioned beneath the strip (2), by a pivotable strip bending member (61) arranged above the strip (2).

* * * * *